US006415777B1

(12) United States Patent
Gagnon

(10) Patent No.: US 6,415,777 B1
(45) Date of Patent: Jul. 9, 2002

(54) EGR MODULE HAVING ORIFICE IN A PRESSURE SENSING PORT

(75) Inventor: Frederic Gagnon, Chatham (CA)

(73) Assignee: Siemens Automotive Inc., Chatham (CA)

( * ) Notice: Subject to any disclaimer, the term of this patent is extended or adjusted under 35 U.S.C. 154(b) by 0 days.

(21) Appl. No.: 09/723,798

(22) Filed: Nov. 28, 2000

(51) Int. Cl.[7] ..... F02M 25/07
(52) U.S. Cl. ..... 123/568.29
(58) Field of Search ..... 123/568.11, 568.26–568.29; 137/907

(56) References Cited

U.S. PATENT DOCUMENTS 5,613,479 A 3/1997 Gates et al. ..... 123/568
6,116,224 A 9/2000 Cook et al. ..... 123/568.27
6,170,476 B1 * 1/2001 Cook et al. ..... 123/568.27

OTHER PUBLICATIONS

US 6,092,513, 072000, Kotwicki et al. (withdrawn).

* cited by examiner

*Primary Examiner*—Willis R. Wolfe
*Assistant Examiner*—Arnold Castro

(57) ABSTRACT

An internal combustion engine exhaust emission control system has a module for conveying exhaust gas from an engine exhaust system to an engine intake system. Flow is measured by the difference between pressures at opposite sides of an orifice in the exhaust gas flow path. A valve selectively restricts the flow path. Passages communicate pressure reading ports of a pressure sensor to opposite sides of the orifice. One passage comprises a tube having an end portion passing through a through-hole in a side wall of the flow path in alignment with the orifice in the flow path and containing an orifice member that faces the flow path orifice to reduce turbulence in the pressure communicated through it to the sensor.

19 Claims, 1 Drawing Sheet

EGR MODULE HAVING ORIFICE IN A PRESSURE SENSING PORT

FIELD OF THE INVENTION

This invention relates generally to automotive emission control valves and systems, such as exhaust gas recirculation (EGR) valves that are used in exhaust emission control systems of automotive vehicle internal combustion engines. More specifically, the invention relates to an improvement for measuring the gas flow in an emission control valve and/or system via pressure sensing ports on opposite sides of an orifice.

BACKGROUND OF THE INVENTION

Commonly owned U.S. Pat. No. 6,116,224 (Cook and Busato) discloses an EGR system comprising an EGR module. One element of that module is a pressure sensor that senses pressure differential across a circular orifice through which exhaust gas flow is constrained to pass when a valve of the module allows flow to the engine intake system.

A circular orifice of given diameter possesses a known relationship between flow through the orifice and pressure drop across the orifice. In other words, flow through the orifice, and hence flow through the module, can be calculated by measurement of pressure drop across the orifice and applying the known flow/pressure drop relationship to the pressure drop measurement. U.S. Pat. No. 6,116,224 shows various embodiments for communicating the pressure drop across the orifice to the pressure sensor.

U.S. Pat. No. 5,613,479 discloses an EGR system that uses a similar general principle for measurement of EGR flow. Sensing port taps sense pressure difference across an orifice through which exhaust gas flow is constrained to pass. The orifice is disposed in a straight section of pipe that is provided with openings in its side wall at opposite sides of the orifice. An end portion of a sensing port tube is fit to a respective opening such that a tip of the end portion protrudes slightly into the pipe. The tip end of each sensing port tube is necked down to create at the tube entrance a restrictor having a diameter less than the nominal diameter of the tube. The restrictor thereby forms an orifice as the tube entrance. Each sensing port tube is connected through a rubber hose to a differential pressure sensor. The restrictors are said to reduce audible noise emanating from the EGR system as a result of exhaust pulsations transmitted through the rubbers hoses.

SUMMARY OF THE INVENTION

One generic aspect of the invention relates to an internal combustion engine exhaust emission control system comprising a flow path for conveying exhaust gas from an exhaust system of the engine to an intake system of the engine and comprising an orifice through which exhaust gas flow is constrained to pass. A valve selectively restricts the flow path. A first port communicates pressure in the flow path at a location upstream of the orifice to a first pressure reading port. A second port communicates pressure in the flow path at a location downstream of the orifice to a second pressure reading port. The pressure communicated through the first port is communicated through a flow restrictor proximate the flow path that imposes a greater restriction on the communication of the flow path to the first pressure reading port than any restriction imposed on the communication of the flow path to the second pressure reading port.

A further generic aspect relates to an internal combustion engine exhaust emission control system comprising a flow path for conveying exhaust gas from an exhaust system of the engine to an intake system of the engine and comprising an orifice through which exhaust gas flow is constrained to pass. A valve selectively restricts the flow path. A first port communicates pressure in the flow path at a location upstream of the orifice to a first pressure reading port. A second port communicates pressure in the flow path at a location downstream of the orifice to a second pressure reading port. The pressure communicated through one of the ports to the corresponding pressure reading port is communicated through an orifice that faces the orifice in the flow path.

One more generic aspect relates to an exhaust gas recirculation valve comprising a valve body for conveying exhaust gas from an exhaust system of a combustion engine to an intake system of the engine and comprising an orifice through which exhaust gas flow is constrained to pass. A valve selectively restricts the flow path. A first port communicates pressure in the flow path at a location upstream of the orifice to a first pressure reading port. A second port communicates pressure in the flow path at a location downstream of the orifice to a second pressure reading port. The pressure communicated through one of the ports to the corresponding pressure reading port is communicated through an orifice that faces the orifice in the flow path.

BRIEF DESCRIPTION OF THE DRAWING

The accompanying drawing, which is incorporated herein and constitutes part of this specification, includes a preferred embodiment of the invention, and together with a general description given above and a detailed description given below, serves to disclose principles of the invention in accordance with a best mode contemplated for carrying out the invention.

DESCRIPTION OF THE PREFERRED EMBODIMENT

Figure 1:
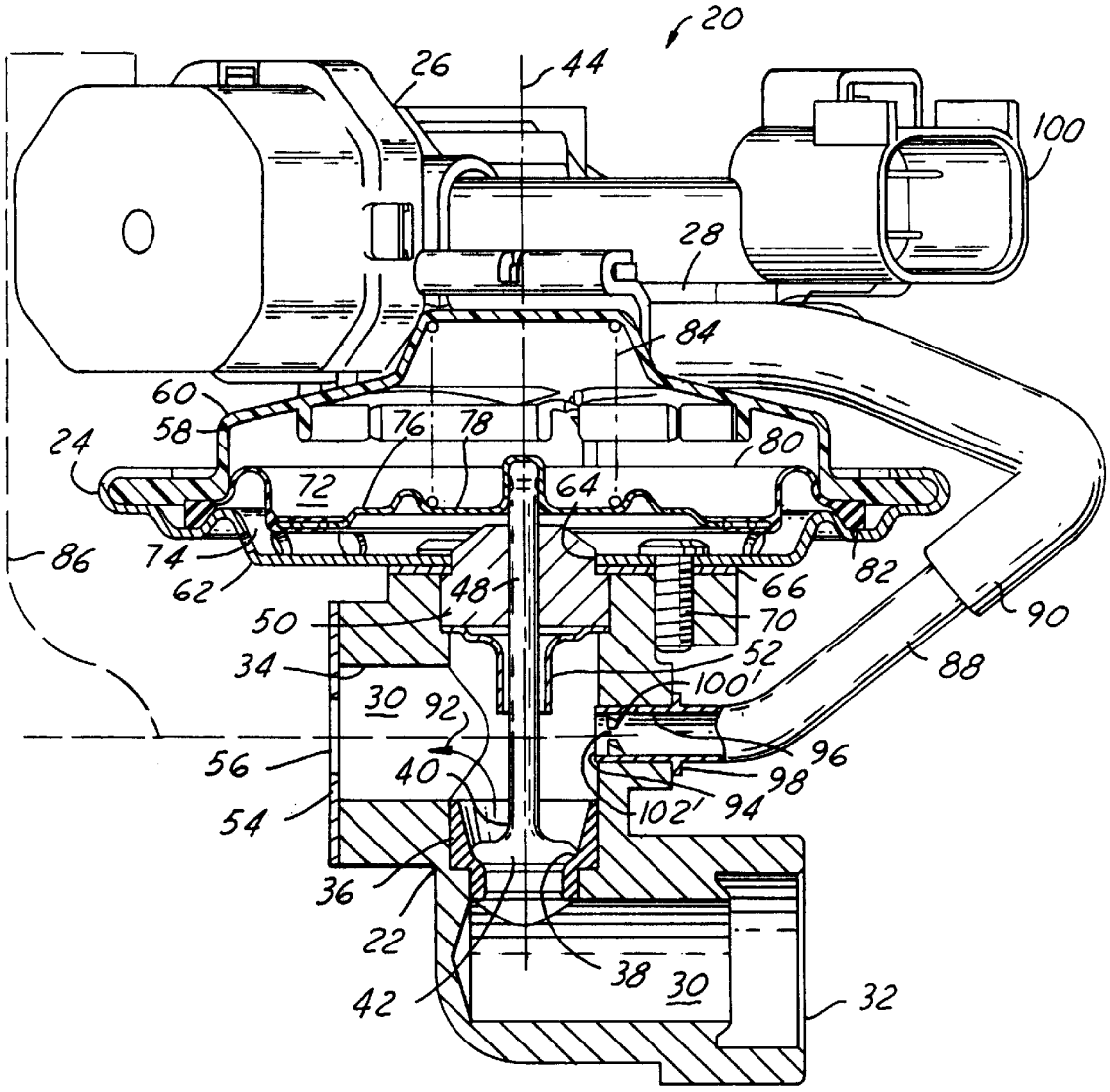
FIG. 1 is a front elevation view, partly in cross section, of an exemplary module embodying principles of the present invention.

FIG. 1 discloses a module 20 embodying principles of the invention and comprising an emission control valve body 22, a fluid-pressure-operated actuator 24, an electric-operated pressure regulator valve 26, and a sensor 28. Valve 26 is an electric-operated vacuum regulator valve, sometimes referred to as an EVR valve, and sensor 28 is a pressure sensor that provides an electric signal related to the magnitude of sensed vacuum.

Valve body 22 comprises an internal main flow passage 30 extending between a first port 32 and a second port 34. An annular valve seat element 36 is disposed in valve body 22 to provide an annular seat surface 38 circumscribing a transverse cross-sectional area of passage 30. A valve member 40 comprising a non-flow-through valve head 42 is disposed within body 22 coaxial with an imaginary axis 44. Valve head 42 is shown seated on seat surface 38 closing passage 30 to flow between ports 32 and 34.

A stem 48 extends from valve head 42 to operatively connect head 42 with actuator 24 for operating valve member 40 via the actuator. Stem 48 passes with a close sliding fit through a bushing 50 that is fit to body 22 and guides valve member 40 for straight line motion along axis 44. Bushing 50 also captures the outer margin of a circular flange of a generally cylindrical walled metal shield 52 on an internal shoulder of valve body 22. Shield 52 surrounds a portion of stem 48 to direct exhaust gas heat away from the stem when exhaust gas flows through valve body 22. A thin orifice member 54 comprising a circular orifice 56 is disposed at port 34 such that flow through main flow passage 30 is constrained to pass through orifice 56.

Fluid-pressure-operated actuator 24 comprises a body 58 that is in assembly with valve body 22 coaxial with axis 44. Actuator body 58 comprises a first body part 60 and a second body part 62. Body part 62 comprises sheet metal formed to a generally circular shape having a central through-hole 64 that allows the part to fit over a protruding end of bushing 50. An annular gasket 66 is sandwiched between actuator body part 62 and valve body 22. Actuator body part 62, gasket 66, and valve body 22 each contains a like hole pattern that provides for the secure attachment of part 62 to valve body 22 by headed screws 70 whose threaded shanks are passed through aligned holes in part 62 and gasket 66 and tightened into threaded holes in body 22.

Actuator body 58 comprises an interior that is divided into two chamber spaces 72, 74 by a movable actuator wall 76. Movable actuator wall 76 comprises an inner formed metal part 78 and an outer flexible part 80. Part 80 has a circular annular shape including a convolution that rolls as wall 76 moves. Part 80 also has a bead 82 which extends continuously around its outer margin and is held compressed between parts 60 and 62 by an outer margin of body part 62 being folded around and crimped against the outer margin of part 60, thereby securing parts 60, 62, and 76 in assembly and sealing the outer perimeters of chamber spaces 72 and 74. The inner margin of part 80 is insert-molded onto the outer margin of part 78 to create a fluid-tight joint uniting the two parts. Several through-holes in part 62 communicate chamber space 74 to atmosphere. A helical coil compression spring 84 is disposed within chamber space 72 to resiliently bias movable wall 76 axially toward valve seat surface 38, thereby urging valve head 42 toward seating on seat surface 38, and thereby closing passage 30 to flow between ports 32 and 34.

EVR valve 26 comprises a body having an atmospheric inlet port for communication to atmosphere, a source vacuum inlet port for communication to engine intake system vacuum, and a regulated vacuum outlet port. It contains an internal regulating mechanism like that of the EVR valves described in U.S. Pat. Nos. 5,448,981, and 6,116,224.

The internal mechanism of EVR valve 26 further comprises a solenoid that is operated by pulse width modulation. The pulse width modulation of the solenoid modulates the bleeding of vacuum to atmosphere to cause the vacuum in an internal chamber space to be regulated in accordance with the degree of signal modulation within a range that extends essentially from full intake system vacuum applied at the vacuum inlet port to essentially atmospheric pressure applied at the atmospheric inlet port. The regulated vacuum outlet port is directly in communication with that internal chamber space. An internal passage extends from that the regulated vacuum outlet port to actuator chamber space 72 to place the latter in fluid communication with the regulated vacuum in EVR valve 26. Because the regulated vacuum is established by modulation of the solenoid and is communicated to chamber space 72, the extent to which wall 76, and hence valve member 40, is moved along axis 44 against the resistance of spring 84 is controlled by the electric signal applied to the EVR solenoid. In this way, EGR flow to the engine intake system is closely controlled.

Intake system vacuum is communicated to a first pressure sensing port of sensor 28 in any suitable way, for example such as through a tube schematically shown at 86. The tube communicates the intake system side of orifice 56 to the first pressure reading port of sensor 28.

Sensor 28 comprises a second pressure reading port that is communicated to pressure at the opposite side of orifice 56. The communication is established by a conduit comprising two tubes 88, 90 fitted together end-to-end. The side wall of valve body 22 bounding main flow path 30 comprises a right angle bend marked generally by the arrow 92. That bend is disposed between valve seat surface 38 and orifice member 54. Hence, orifice 56 is disposed downstream of the bend.

Tube 88 is a formed metal tube having an open free end 94 that is opposite the end that is fitted to tube 90. An end portion of tube 88 passes through a through-hole 96 in the wall of valve body 22 to communicate open free end 94 to main flow path 30. Through-hole 96 is coaxial with orifice 56, and open free end 94 faces and is also coaxial with orifice 56. Although stem 48 is disposed between open free end 94 and orifice 56, pressure in the flow path upstream of the orifice can be accurately transmitted to pressure sensor 28. Tube 88 includes an external shoulder 98 that abuts the exterior of valve body 22 surrounding through-hole 96 so that the open free end is accurately positioned at a desired distance in relation to the interior wall surface of main flow path 30 that contains the through-hole.

An electric connector 100 provides for sensor 28 and EVR valve 26 to be connected with an electric control circuit (not shown). Connector 100 contains five electric terminals, three of which are associated with sensor 28 and two of which, with EVR valve 26. When connector 100 is connected with a mating connector (not shown) leading to the electric circuit that operates module 20, two electric terminals carry pulse width modulated current to the EVR solenoid, and three terminals carry electric current signals related to pressures sensed at the two sensing ports of sensor 28.

The improvement provided by the present invention comprises an orifice member 100' disposed inside tube 88, just interior of free end 94. Orifice member 100' comprises an outer margin that is fit to the tube wall and sealed thereto in a secure manner, and at its center, it comprises a circular orifice 102'. Hence pressure read by sensor 28 through tubes 88, 90 is communicated through orifice 102'. Orifice 102' and orifice 56 are disposed in spaced apart, parallel planes, and the two are centered on a common linear axis.

No corresponding orifice in pressure sensing tube 86 is necessarily required. Prior to inclusion of orifice member 100', a certain turbulence was affecting the static pressure measurement reading at the upstream sensing port, i.e. at the second pressure reading port of sensor 28 communicated through tubes 90, 88, to main flow path 30 proximate bend 92. The inclusion of orifice member 100' was found to reduce errors in the readings due to turbulence. It was also discovered that the inclusion of orifice member 100' provided better resolution, and hence greater accuracy, in readings taken at low EGR flow rates.

It is to be understood that because the invention may be practiced in various forms within the scope of the appended claims, certain specific words and phrases that may be used to describe a particular exemplary embodiment of the invention are not intended to necessarily limit the scope of the invention solely on account of such use.

What is claimed is:

1. An internal combustion engine exhaust emission control system comprising:

a flow path for conveying exhaust gas from an exhaust system of the engine to an intake system of the engine and comprising an orifice through which exhaust gas flow is constrained to pass, a valve for selectively restricting the flow path, a first port through which pressure in the flow path at a location upstream of the orifice is communicated to a first pressure reading port, and a second port through which pressure in the flow path at a location downstream of the orifice is communicated to a second pressure reading port, wherein the pressure communicated through the first port is communicated through a flow restrictor proximate the flow path that imposes a greater restriction on the communication of the flow path to the first pressure reading port than any restriction imposed on the communication of the flow path to the second pressure reading port.

2. An internal combustion engine exhaust emission control system as set forth in claim 1 in which the side wall bounding a portion of the flow path comprises a valve body having a through-passage extending between an inlet port and a valve seat disposed between the inlet port and the outlet port circumscribing the through-passage, the through-passage comprises a bend between the valve seat and the outlet port, the orifice is disposed downstream of the bend, and the first port through which pressure in the flow path at a location upstream of the orifice is communicated to a first pressure reading port comprises a tube having an open free end facing the device.

3. An internal combustion engine exhaust emission control system as set forth in claim 2 in which the flow restrictor comprises an orifice member disposed within the open free end of the tube and comprising an orifice that restricts the communication to the first pressure reading port.

4. An internal combustion engine exhaust emission control system as set forth in claim 3 in which the orifice in the tube is coaxial with the orifice in the flow path.

5. An internal combustion engine exhaust emission control system as set forth in claim 4 in which the valve comprises a head that coacts with the valve seat to selectively restrict flow through the flow path, and a stem that extends from the valve head to an actuator for positioning the valve head relative to the valve seat and that is disposed between the orifice in the tube and the orifice in the flow path.

6. An internal combustion engine exhaust emission control system comprising:

a flow path for conveying exhaust gas from an exhaust system of the engine to an intake system of the engine and comprising an orifice through which exhaust gas flow is constrained to pass, a valve for selectively restricting the flow path, a first port through which pressure in the flow path at a location upstream of the orifice is communicated to a first pressure reading port, and a second port through which pressure in the flow path at a location downstream of the orifice is communicated to a second pressure reading port, wherein the pressure communicated through one of the ports to the corresponding pressure reading port is communicated through an orifice that faces the orifice in the flow path.

7. An internal combustion engine exhaust emission control system as set forth in claim 6 in which both orifices are disposed in spaced apart parallel planes.

8. An internal combustion engine exhaust emission control system as set forth in claim 7 in which the orifice that faces the orifice in the flow path is disposed in the first port through which pressure in the flow path at a location upstream of the orifice is communicated to the first pressure reading port.

9. An internal combustion engine exhaust emission control system as set forth in claim 6 in which both orifices are centered on a common linear axis.

10. An internal combustion engine exhaust emission control system as set forth in claim 9 in which the orifice that faces the orifice in the flow path is disposed in the first port through which pressure in the flow path at a location upstream of the orifice is communicated to the first pressure reading port.

11. An internal combustion engine exhaust emission control system as set forth in claim 6 in which the side wall bounding a portion of the flow path comprises a valve body having a through-passage extending between an inlet port and a valve seat disposed between the inlet port and the outlet port circumscribing the through-passage, the through-passage comprises a bend between the valve seat and the outlet port, the orifice in the flow path device is disposed downstream of the bend and the orifice that faces the orifice in the flow path is disposed at the bend.

12. An internal combustion engine exhaust emission control system as set forth in claim 11 in which the valve comprises a head that coacts with the valve seat to selectively restrict flow through the flow path, and a stem that extends from the valve head to an actuator for positioning the valve head relative to the valve seat and that is disposed between the orifice in the flow path and the orifice that faces the orifice in the flow path.

13. An exhaust gas recirculation valve comprising:

a valve body for conveying exhaust gas from an exhaust system of a combustion engine to an intake system of the engine and comprising an orifice through which exhaust gas flow is constrained to pass, a valve for selectively restricting the flow path, a first port through which pressure in the flow path at a location upstream of the orifice is communicated to a first pressure reading port, and a second port through which pressure in the flow path at a location downstream of the orifice is communicated to a second pressure reading port, wherein the pressure communicated through one of the ports to the corresponding pressure reading port is communicated through an orifice that faces the orifice in the flow path.

14. An internal combustion engine exhaust emission control system as set forth in claim 13 in which both orifices are disposed in spaced apart parallel planes.

15. An internal combustion engine exhaust emission control system as set forth in claim 14 in which the orifice that faces the orifice in the flow path is disposed in the first port through which pressure in the flow path at a location upstream of the orifice is communicated to the first pressure reading port.

16. An internal combustion engine exhaust emission control system as set forth in claim 13 in which both orifices are centered on a common linear axis.

17. An internal combustion engine exhaust emission control system as set forth in claim 16 in which the orifice that faces the orifice in the flow path is disposed in the first port through which pressure in the flow path at a location upstream of the orifice is communicated to the first pressure reading port.

18. An internal combustion engine exhaust emission control system as set forth in claim 13 in which the flow path through the valve body extends between an inlet port and an outlet port, a valve seat is disposed between the inlet port and the outlet port circumscribing the flow path, the flow path comprises a bend between the valve seat and the outlet port, the orifice in the flow path device is disposed downstream of the bend and the orifice that faces the orifice in the flow path is disposed at the bend.

19. An internal combustion engine exhaust emission control system as set forth in claim 18 in which the valve comprises a head that coacts with the valve seat to selectively restrict flow through the flow path, and a stem that extends from the valve head to an actuator for positioning the valve head relative to the valve seat and that is disposed between the orifice in the flow path and the orifice that faces the orifice in the flow path.

* * * * *